United States Patent [19]

Uchida et al.

[11] Patent Number: 4,492,218

[45] Date of Patent: Jan. 8, 1985

[54] OIL STOVE

[75] Inventors: Tetsue Uchida; Takao Adachi, both of Sanjyo, Japan

[73] Assignee: Uchida Manufacturing Co., Ltd., Japan

[21] Appl. No.: 469,908

[22] Filed: Feb. 25, 1983

[51] Int. Cl.[3] ..... F24C 5/04

[52] U.S. Cl. ..... 126/96; 126/93; 126/202

[58] Field of Search ..... 126/116 B, 96, 93, 46, 126/49, 50, 214 D, 201, 202, 298, 236, 24, 57; 431/302, 310, 298, 301; 74/308, 312; 432/33, 34, 88

[56] References Cited

U.S. PATENT DOCUMENTS 1,944,492 1/1934 Chadwick et al. ..... 126/96 X

*Primary Examiner*—James C. Yeung
*Assistant Examiner*—G. Anderson
*Attorney, Agent, or Firm*—Cushman, Darby & Cushman

[57] ABSTRACT

An improved oil stove of the type including a cylindrical burning wick adapted to be displaced up and down as required is disclosed which ensures that a burning sleeve is entirely disconnected from a hot dish containing the burning wick therein when the oil stove falls forward due to an occurrence of an earthquake or the like. The improvement consists in that a guard comprising a certain number of fence rods is additionally provided with a guide member fixedly secured thereto. The guide member serves to hold the head portion of the burning sleeve when the oil stove falls forward and then the burning sleeve is tilted from the normal position. The tilted burning sleeve is then displaced due to its dead weight in such a direction as to be parted away from the hot dish so that quick extinguishment and prevention of generation of incompletely burnt gas are ensured.

The guide member constitutes a part of the guard in such a manner that it extends in parallel to the fence rods and is welded to the guard at both the ends thereof. The guide member may have a flattened M-shaped configuration as seen from the above while it is attached to the guard. Alternatively, it may have an arcuate bent portion at its middle part as seen from the above of which configuration corresponds substantially to that of the burning sleeve.

3 Claims, 8 Drawing Figures

OIL STOVE

BACKGROUND OF THE INVENTION

1. Field of the Invention

The present invention relates to an oil stove and more particularly to an improved oil stove of the type including a cylindrical burning wick adapted to be displaced up and down as required, wherein there is no fear of causing such a malfunction as delayed fire extinguishment, continuation of evaporation of kerosene, generation of incompletely burnt gas or the like due to the fact that a burning sleeve fails to be disconnected from a hot dish and thereby the cylindrical burning wick is still exposed to the high temperature portion of the burning cylinder when the oil stove falls forward because of an occurrence of an earthquake or the like.

2. Description of the Prior Art

One of disadvantageous features as found out with the conventional oil stove of the above-mentioned type is that there is a tendency that the burning sleeve often fails to be disconnected from the hot dish when the oil stove falls forward due to an occurrence of an earthquake or the like. This is attributable mainly to the fact that the head portion of the burning sleeve is caused to anchor at one of fence rods constituting a front guard for the oil stove after the oil stove falls forward. Thus, the burning sleeve is by no means disconnected or disengaged from the hot dish any longer whereby delayed fire extinguishment, continuation of evaporation of kerosene, generation of incompletely burnt gas or the like take place individually or in union.

SUMMARY OF THE INVENTION

Thus, the present invention is intended to provide an improved oil stove of the above-described type which is entirely free from the drawback inherent to the conventional one as described above. To ensure that the burning sleeve is completely parted away from the hot dish when the oil stove falls forward for any reason such as an occurrence of an earthquake or the like the oil stove in accordance with the present invention is constructed such that the front guard including a certain number of horizontally extending fence rods is additionally provided with a guide member adapted to hold the head portion of the burning sleeve when the oil stove falls forward and then allow it to move in such a direction as to be disconnected or disengaged from the hot dish.

Specifically, the guide member constituting a part of the guard is disposed in front of the burning sleeve at the inside relative to the guard in such a manner that it extends in parallel to the fence rods of the guard. When the oil stove falls forward on the floor or ground and the burning sleeve is then tilted against the guide member, it is caused to move due to the dead weight of the burning sleeve in such a direction as to be displaced away from the high temperature area at the bottom part of the burning sleeve whereby quick fire extinguishment is achieved with reduced generation of incompletely burnt gas.

The horizontally extending guide member is welded to vertically extending support rods at both the side ends of the guard by way of arms which form the end parts of the guide member by bending at a right angle relative to the latter. Thus, it has a rectangular configuration as seen from the above while it is attached to the guard.

In a modified embodiment of the present invention the guide member has a flattened M-shaped configuration as seen from the above while it is attached to the guard.

In another modified embodiment of the present invention the guide member has an arcuate bent portion at its middle part as seen from the above of which configuration corresponds substantially to that of the burning sleeve.

Hence, it is an object of the present invention to provide an oil stove of the type including a cylindrical burning wick which ensures that the burning sleeve is completely disconnected from the hot dish in the event of an occurrence of an earthquake or the like without any possibility of causing such a malfunction as delayed fire extinguishment, continuation of evaporation of kerosene and generation of incompletely burnt gas.

It is other object of the present invention to provide an oil stove of the above-mentioned type in which the improvement is practiced in a simple manner at an inexpensive cost.

It is another object of the present invention to provide an oil stove of the above-mentioned type in which the improvement requires no additional space and weight.

Other objects, features and advantages of the invention will become apparent from the reading of the following specification made in conjunction with the accompanying drawings.

BRIEF DESCRIPTION OF THE DRAWINGS

The accompanying drawings will be briefly described below.

FIG. 2 is a vertical sectional side view of the oil stove in FIG. 1, wherein it falls forward due to an occurrence of an earthquake or the like.

FIG. 5 is a vertical sectional side view of the oil stove in FIG. 3, wherein it falls forward due to an occurrence of an earthquake or the like.

DETAILED DESCRIPTION OF THE INVENTION

Figure 2:
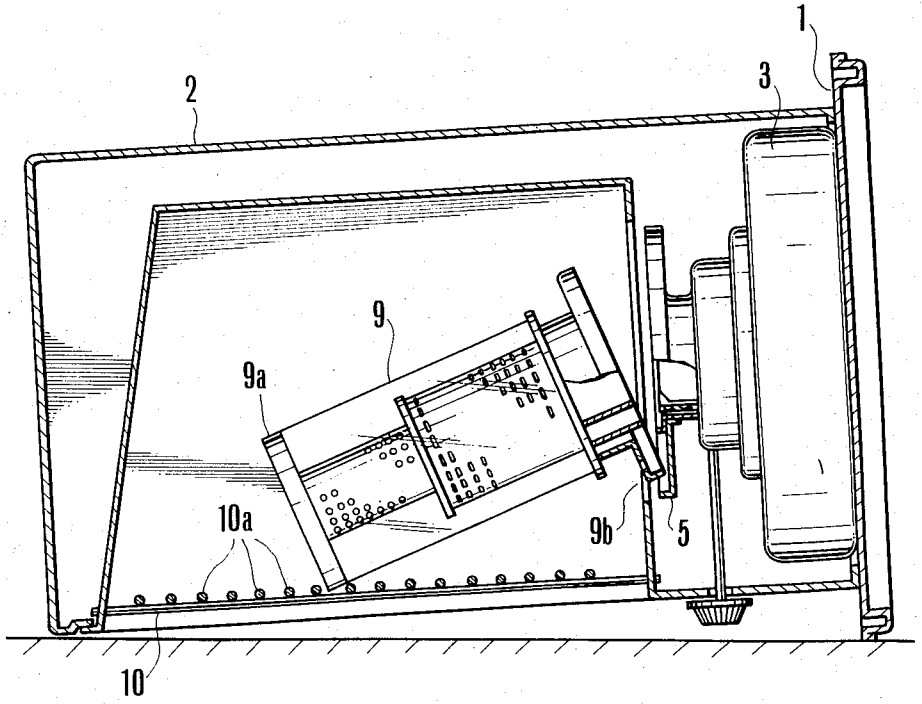
Figure 1:
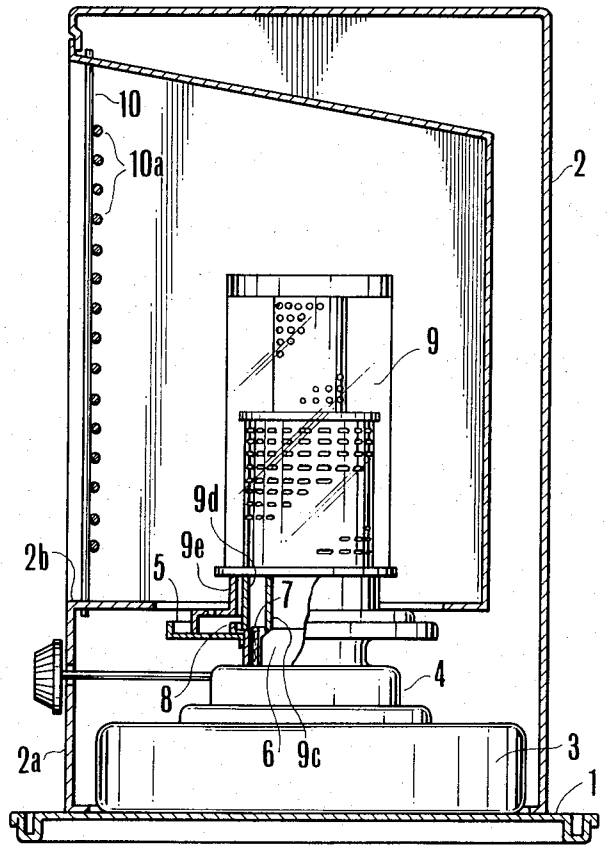
FIG. 1 is a vertical sectional side view of a conventional oil stove.

To facilitate complete understanding of the present invention it will be helpful that a typical conventional oil stove will be briefly described hereunder with reference to FIGS. 1 and 2.

As is readily apparent from FIG. 1, the conventional oil stove essentially comprises a base 1, a cabinet 2 fixedly mounted on said base 1 and an oil tank 3 fixedly mounted on the base 1 at the lower part of the cabinet 2, said oil tank 3 including a wick guiding portion 4. An annular wind shielding plate 5 is disposed at the upper end part of the wick guiding portion 4 and an inner wick guide sleeve 6 is included in the wick guiding portion 4 so as to allow a burning wick 7 to be displaced up and down along the outer surface of said inner wick guide sleeve 6 as required. Further, a circular hot dish 8 is fixedly fitted to the upper end part of the wick guiding portion 4. A burning sleeve 9 is mounted above the circular hot dish 8 in such a manner as to cover the burning wick 7.

The burning sleeve 9 is constructed in the cylindrical configuration and has a burning chamber as defined by a combination of an inner sleeve 9*c* an intermediate sleeve 9*d* located outward of said inner sleeve 9*c*. Both the inner and intermediate sleeves 9*c* and 9*d* have a certain number of communication holes which are not shown in the drawings. Outward of the intermediate sleeve 9*d* is disposed an outer sleeve 9*e* which is integrally fitted with a wind shielding glass sleeve 9*f* in the proximity of the upper end thereof.

As shown in FIG. 1, the lower end of the inner sleeve 9*c* abuts against the upper end of the inner wick guide sleeve 6, the lower end of the intermediate sleeve 9*d* does against the circular hot dish 8 and the lower end of the outer sleeve 9*e* does against the wind shielding disc 5.

The cabinet 2 has a front plate 2*a* at the lower end part of its front side and a wide rectangular cutout 2*b* is formed above said front plate 2*a* while it is located upward of the wind shielding plate 5. A number of steel rods 10*a* extend across the rectangular opening 2*b* just like a fence structure whereby a guard 10 is constructed.

When the oil stove as constructed in the above-described manner falls forward on the floor or ground due to an occurrence of an earthquake or the like, the burning sleeve 9 placed on the circular hot dish 8 is caused to tilt on the guard 10 due to its own dead weight. Since the burning sleeve 9 is subjected to centrifugal force during the forward tilting, the result is that the head portion 9*a* of the burning sleeve 9 abuts against the guard 10 quicker than the bottom portion 9*b* of the same. This causes the head portion 9*a* to come in contact with the guard 10 and anchor at one of the fence rods 10*a* before the bottom portion 9*b* is compltetely disconnected from the circular hot dish 8. Thus, there is a tendency that the bottom portion 9*b* of the burning sleeve 9 fails to be disengaged from the circular hot dish 8.

As is well known, the inner walls of both the inner sleeve 9*d* and the intermediate sleeve 9*d* are exposed to an elevated temperature in the range of 400° C. to 500° C. particularly at the bottom portion 9*b* of the burning sleeve 9 while the oil stove is burning. Since the bottom portion 9*b* of the burning sleeve 9 often fails to be disconnected from the circular hot dish 8 for the above-described reason after the oil stove falls forward due to an occurrence of an earthquake or the like, the upper end part of the burning wick 7 is still exposed to the hot bottom portion 9*b* of the burning sleeve 9 in spite of the fact that the burning wick 7 is automatically retracted downward by means of a fire extinguishing mechanism (not shown) immediately after the oil stove falls forward, resulting in continuation of evaporation of kerosene, delayed extinguishment and generation of incompletely burnt gas.

Thus, the present invention is intended to obviate the above-mentioned problem inherent to the conventional oil stove.

Now, the present invention will be described in a greater detail with reference to FIGS. 3 to 8 which illustrate preferred embodiments of the invention.

Figure 3:
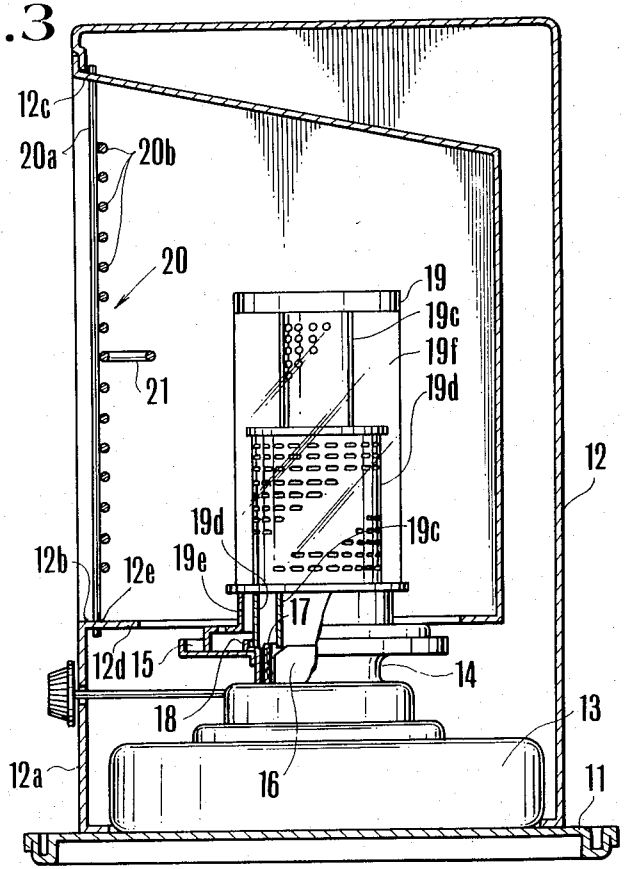
FIG. 3 is a vertical sectional side view of an oil stove in accordance with an embodiment of the present invention.
Figure 4:
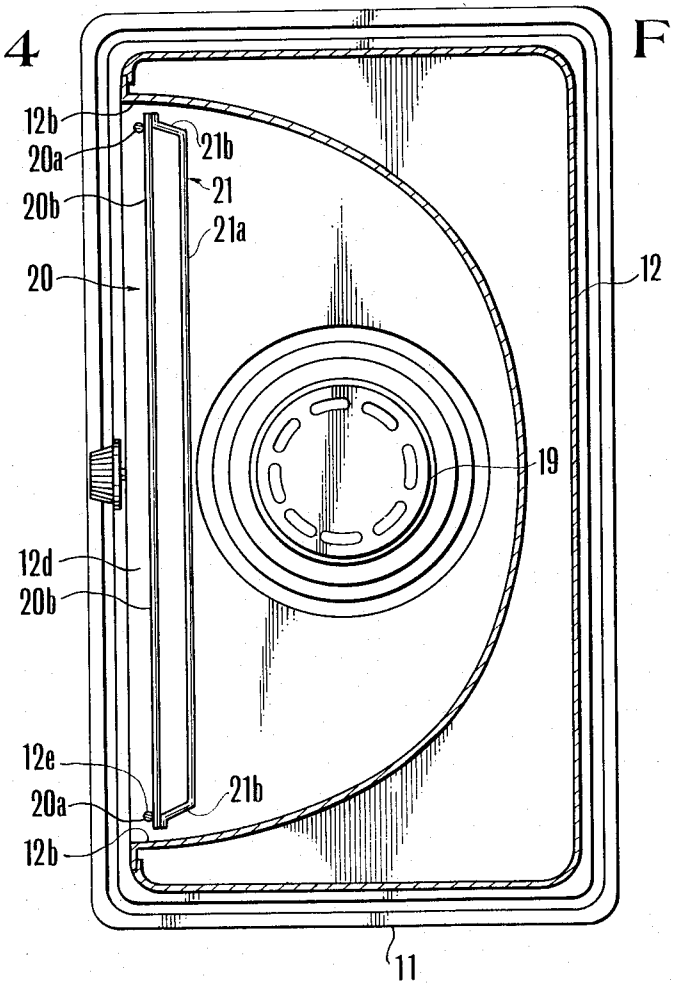
FIG. 4 is a sectional plan view of the oil stove in FIG. 3.

Referring first to FIG. 3, a cabinet 12 is fixedly mounted on a base 11 of the oil stove. The cabinet 12 is designed in the box-shaped configuration of which front surface (located at the left side as seen in the drawing) is opened to the outside. Specifically, the front portion of the cabinet 12 includes a front plate 12*a* at the lower end part and a rectangular cutout 12*b* located above said front plate 12*a*.

Further, an oil tank 13 is fixedly mounted on the base 11 in the cabient 12 and a burning wick guide sleeve 14 is firmly secured to the upper surface of the oil tank 13. On the upper end edge of the burning wick guide sleeve 14 is disposed an annular wind shielding plate 15, whereas inside the burning wick guide sleeve 14 is displaceably fitted a cylindrical burning wick 17 with an inner wick guide sleeve 16 fixedly located inward of said burning wick 17. A circular hot dish 18 is disposed inward of said wind shielding plate 15 and a burning sleeve 19 is mounted on the circular hot dish 18 in such a manner as to cover the burning wick 17.

As is apparent from the drawings, the burning sleeve 19 is constructed in the cylindrical configuration and includes an inner sleeve 19*c* and an intermediate sleeve 19*d* located outward of said inner sleeve 19*c* so as to define a burning chamber therebetween, wherein both the inner and intermediate sleeves 19*c* and 19*d* have communication holes (Not shown) formed on the cylindrical wall thereof. Further, an outer sleeve 19*a* is disposed outward of the intermediate sleeve 19*d* and a wind shielding glass sleeve 19*f* is integrally secured to the outer end of the outer sleeve 19*e*. It should be noted that the lower end of the inner sleeve 19*c* abuts against the inner wick guide sleeve 16, the lower end of the intermediate sleeve 19*d* does against the annular hot edge 18 and the lower end of the outer sleeve 19*e* does against the wind shielding disc 15.

The cutout 12*b* of the cabinet 12 is fitted with a guard 20 adapted to be removed therefrom as required. As is apparent from FIGS. 3 and 6, the guard 20 includes two vertically extending support rods 20*a* and a certain number of fence rods 20*b* extending horizontally between said support rods 20*a* across the width of the cutout 12*b*, said fence rods 20*b* being welded to the support rods 20*a* and spaced at a certain distance from one another.

A guide member 21 constituting an essential part of the invention is fixedly secured to one of the fence rods 20*b* at the rear side of the latter as seen from the cutout 12*b*. The guide member 21 is made of the same steel rod material as that of the fence rods 20*b* and extends in parallel to the latter so as to be welded thereto by way of arms 20*b* at both the end parts of the guide member 21.

The guard 20 is removably fitted in the cutout 12*b* by inserting the upper and lower end parts of the support rods 20*a* into holes 12*e* on the upper and lower wall plates 12*c* and 12*d*.

Now, operation of the oil stove constructed as described above will be described below.

Figure 5:
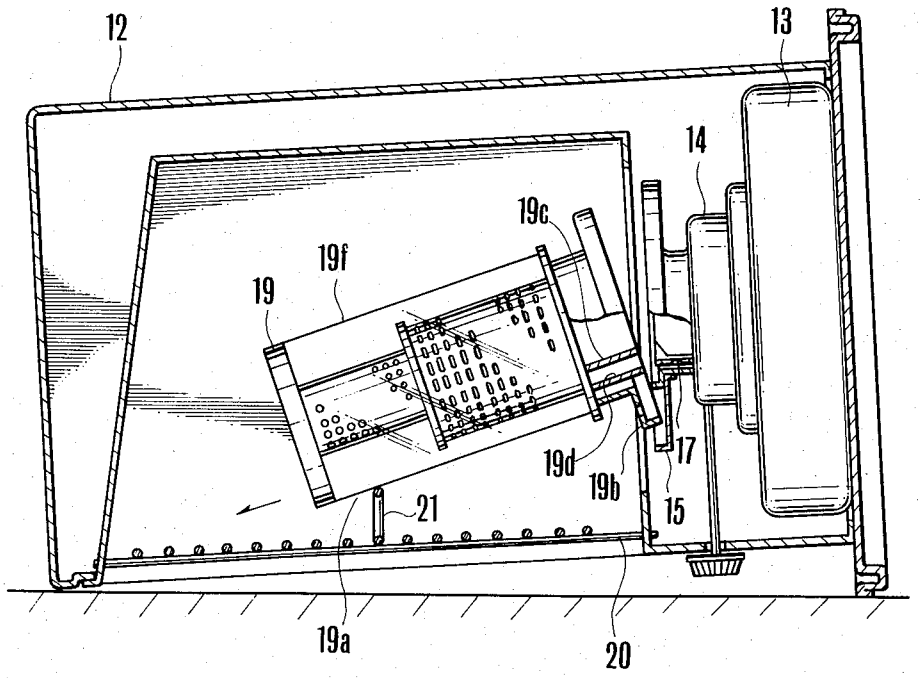

When the oil stove falls forward on the floor or ground due to an occurrence of an earthquake or the like as illustrated in FIG. 5, the burning sleeve 19 tilts against the guide member 21 with its head portion 19*a* brought in contact with the latter and then it moves in the direction as identified with an arrow mark, causing the bottom portion 19*b* of the burning sleeve 19 to be disconnected from the circular hot dish 18 so that it falls on the guard 20.

As a result the hot bottom parts of the inner sleeve 19*c* and the intermediate sleeve 19*d* are parted away from the burning wick 17 until the latter is not thermally affected by them. Thus, it is ensured that the burning wick 17 is extinguished without delay and any incompletely burnt gas is not generated therefrom because of no exposure to the high temperature area of the burning sleeve 19.

The present invention has been described above with respect to the illustrated embodiment but it should be of course understood that the invention should be not limited only to it and various changes or modifications may be made by any expert in the art without any departure from the spirit and scope of the invention.

Figure 6:
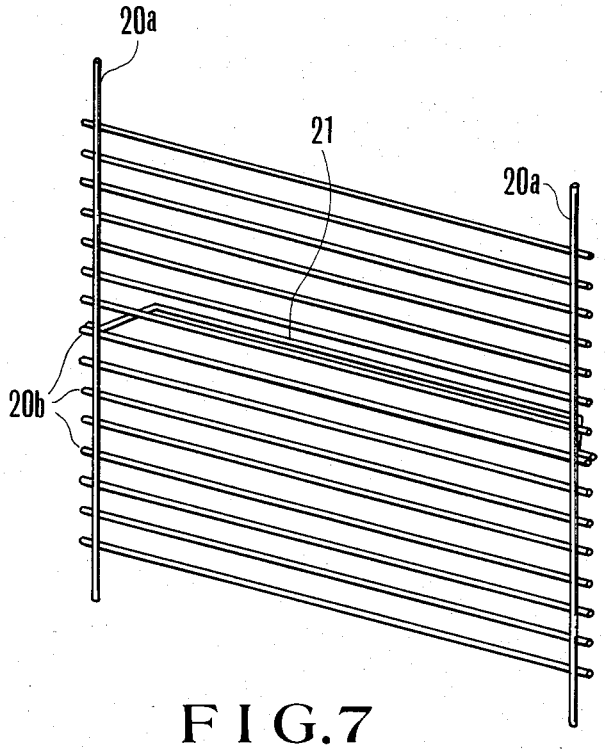
FIG. 6 is a perspective view of an assembly of a guard fence in accordance with the present invention.
Figure 7:
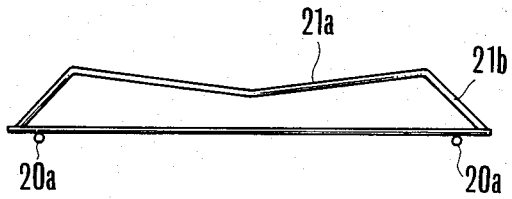
FIG. 7 is a plan view of the guard fence in accordance with a modified embodiment of the present invention.

In view of the fact that the guide member 21 as illustrated in FIG. 6 is bent in a certain arcuate configuration at its central part 21*a* due to the dead weight of the burning sleeve 19 which the oil stove falls forward it may be designed in the flattened M-shaped configuration as illustrated in FIG. 7.

Figure 8:
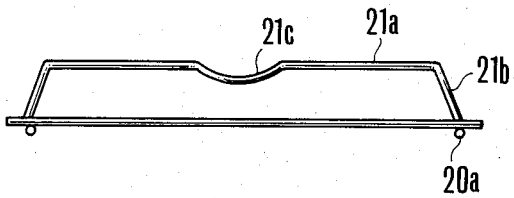
FIG. 8 is a plan view of the guard fence in accordance with another embodiment of the present invention.

Alternatively, the guide member 21 may include an arcuate bent portion 21*c* at the middle part of which configuration corresponds substantially to that of the burning sleeve, as illustrated in FIG. 8.

What is claimed is:

1. An oil stove comprising:

a base;

a cabinet mounted on said base and extending upward therefrom;

a hot dish mounted in said cabinet;

a burning sleeve removably mounted in said cabinet on said hot dish for defining a burning chamber at its lower end and extending upward from said hot dish at said lower end to an upper end;

a cylindrical burning wick adapted to be displaced upwardly and downwardly in said burning chamber;

a guard formed of a plurality of horizontally extending rods fixed to a plurality of vertically extending rods; and a guide member fixedly secured to said guard and extending inwardly therein, said guide member including means defining a surface which comes into contact with said upper end of said burning sleeve when said stove falls over in a forward direction and to thereafter permit said burning sleeve to slide along said defined surface of said guide member to part said lower end from said hot dish.

2. A stove as in claim 1 wherein said surface defining means defines a flattened M-shaped configuration as seen from above.

3. A stove as in claim 1 wherein said surface defining means defines an arcuate bent portion at a middle part of said guide member corresponding to the shape of said burning sleeve.

* * * * *